US005402891A

United States Patent [19]

Haven et al.

[11] Patent Number: 5,402,891

[45] Date of Patent: Apr. 4, 1995

[54] PACKAGE HAVING A BACKING MEMBER WITH FINGER HOLE FLAP WHICH SEPARATES ARTICLES

[75] Inventors: Sandra L. Haven, Florence, Ky.; David R. Bell, Mason, Ohio

[73] Assignee: The Procter & Gamble Company, Cincinnati, Ohio

[21] Appl. No.: 62,528

[22] Filed: May 11, 1993

[51] Int. Cl.[6] ..... B65D 65/00; B65D 73/00

[52] U.S. Cl. ..... 206/477; 206/497; 206/495; 206/466

[58] Field of Search ..... 206/476, 477, 478, 479, 206/480, 481, 482, 483, 495, 497, 466

[56] References Cited

U.S. PATENT DOCUMENTS

| | | | |
|---|---|---|---|
| 1,803,602 | 5/1931 | Dey | 206/482 X |
| 2,224,027 | 12/1940 | Tate | 206/476 |
| 3,130,833 | 4/1964 | Glasser et al. | 206/477 X |
| 3,517,876 | 6/1970 | Stout | 206/197 X |
| 3,593,849 | 7/1971 | Helms et al. | 206/197 X |
| 3,600,871 | 8/1971 | Forquhar | 53/3 |
| 3,750,874 | 8/1973 | Detzer et al. | 206/197 X |
| 3,826,357 | 7/1974 | Roth | 206/497 X |
| 3,908,827 | 9/1975 | Bemmels et al. | 206/473 |
| 4,119,202 | 10/1978 | Roth | 206/497 X |
| 4,548,317 | 10/1985 | Weaver | 206/162 |
| 4,596,330 | 6/1986 | Benno | 206/427 |
| 4,787,509 | 11/1988 | Pasternicki | 206/427 |
| 5,131,542 | 7/1992 | Stenström | 206/476 |
| 5,158,177 | 10/1992 | Negelen et al. | 206/147 |
| 5,168,989 | 12/1992 | Benno | 206/143 |
| 5,228,564 | 7/1993 | Randeria | 206/497 X |

FOREIGN PATENT DOCUMENTS

| | | | |
|---|---|---|---|
| 947246 | 5/1974 | Canada . | |
| 947714 | 5/1975 | Canada . | |
| 735535 | 7/1956 | United Kingdom | 206/478 |

OTHER PUBLICATIONS

Photographs of commercially available packages, identified as Exhibit 1.

*Primary Examiner*—Paul T. Sewell
*Assistant Examiner*—BethAnne C. Cicconi
*Attorney, Agent, or Firm*—Ronald W. Kock; Kevin C. Johnson; Michael E. Hilton

[57] ABSTRACT

A package for multiple articles such as trigger sprayers. The articles are placed adjacent each other and secured against an upright backing member. The backing member has an aperture formed by cutting and folding a flap of the backing member material. The aperture serves as a finger hole for carrying the package while the flap serves as a spacer for separating the adjacent articles. In one embodiment a shrinkband is wrapped around the articles and the backing member to secure the articles to the backing member with the uppermost edge of the shrinkband remaining below the finger hole. In an alternative embodiment a shrinkwrap encases the articles and backing member to secure the articles to the backing member. An access hole may be cut in the shrinkwrap around the finger hole in the backing member if use of the finger hole for handling the package is desired.

10 Claims, 3 Drawing Sheets

PACKAGE HAVING A BACKING MEMBER WITH FINGER HOLE FLAP WHICH SEPARATES ARTICLES

FIELD OF THE INVENTION

The present invention relates to packages containing multiple articles, and more particularly to such packages wherein the articles are secured to a backing member. Even more particularly, the present invention relates to such packages wherein the articles are spaced apart by a flap of backing material which maintains spacing between the articles preventing damage to the articles during shipping and handling.

BACKGROUND OF THE INVENTION

Shrinkwrapping individual articles or multiple articles with a clear polymer wrap is a commonly used approach to package consumer goods. Clear shrinkwrapping provides tamper resistance while permitting consumers to visually examine package contents. Shrinkwrapping also provides a securement means for bundling multiple articles together inexpensively. However, when shrinkwrap material is heated to cause it to shrink, the shrinking action often forces articles inside the wrap to be squeezed closer together. Delicate components of such articles may therefore be damaged by shrinkwrapping. For example, fluid spray pumps are often bundled by shrinkwrapping; however, if the spray nozzle of one pump is squeezed against the body of another pump, permanent deformation of the nozzle of the first pump may result. Also, shrinkwrapped spray pumps having triggers may experience inadvertent trigger activation due to contact between pumps. One approach observed in the marketplace for solving spray pump damage and/or premature trigger activation is the placement of a compressible foam spacer between spray pumps before they are shrinkwrapped. While the spacer prevents contact between nozzle and trigger components of one pump and the body of another, it generates excess packaging material which must be discarded when the package is opened.

Many packages bundled together also have a backing member supporting the articles. The backing member is particularly useful for delicate articles in bundles which are placed in shipping cases, especially when the cases are stacked on top of each other. The backing member, which extends above the top of the articles, resists vertical compression and isolates the articles from the weight of the stacked cases.

Some packages containing multiple articles have overall shapes which are awkward to handle. Removing such packages from an outer case for store shelf stocking or carrying them home is difficult, particularly when individual articles are heavy. Fluid-filled spray pumps are examples of heavy articles frequently bundled together. Such packages may have backing cards which extend well above the articles with one or more finger holes in the backing member for carrying the package.

In general, however, many packages for multiple articles lack the needed damage protection, have an excess of packaging material, and/or are difficult to handle and carry. It is an object of the present invention to overcome these deficiencies.

SUMMARY OF THE INVENTION

In practicing the present invention a backing member is used to protect articles from compression forces associated with stacked outer cases. All articles are placed against one side of the backing member. The flaps are strategically placed in the backing member to space apart portions of articles within the bundle, thereby preventing damageable portions of the articles from contacting one another. Flaps cut in the backing member may also provide finger holes for carrying the packages.

In one preferred embodiment of the present invention a package for multiple articles comprises at least two articles placed adjacent each other, with an upright backing member placed against the articles. The backing member has at least one finger hole. The finger hole is formed by cutting and then folding a flap of the backing member substantially perpendicular to the backing member between the adjacent articles, thereby spacing the articles. Spacing the articles prevents damage to the articles during package handling. There is also a means for securing the adjacent articles against the backing member. The securing means may or may not have an aperture aligned with a finger hole in the backing member so that the finger hole may be used for carrying the package.

In another preferred embodiment of the present invention a package for multiple articles comprises at least two articles with head portions placed adjacent each other and against an upright backing member. The backing member has at least one finger hole. The finger hole is formed in the backing member by cutting an upward-facing C-shaped slit, the C-shape having leg ends, and then by folding the flap about a horizontal axis connecting the leg ends of the C-shaped slit. The flap is folded substantially perpendicular to the backing member between the head portions of the articles. The flap thereby maintains spacing between the head portions of the articles to prevent damage to them. A shrinkwrap encloses the adjacent articles and the backing member to secure the articles to the backing member. The shrinkwrap has an aperture aligned with the finger hole in the backing member to enable the package to be carried by the finger hole. The shrinkwrap supports the adjacent articles and the backing member when the package is carried by the finger hole.

In still another preferred embodiment of the present invention a package for multiple articles comprises at least two articles placed adjacent each other, each of the articles having a base and a head portion. An upright backing member is placed against the articles. The backing member has a bottom edge and at least one finger hole. The finger hole is formed in the backing member by cutting an upward-facing C-shaped slit, the C-shape having leg ends, and then by folding the flap about a horizontal axis connecting the leg ends of the C-shaped slit. The flap is folded substantially perpendicular to the backing member between the head portions of the articles. The flap thereby maintains spacing between the head portions of the articles to prevent damage to them. A shrinkband is then applied to surround adjacent articles and the backing member. The backing member has at least one side notch. The shrinkband has an uppermost edge and a lowermost edge. The lowermost edge of the shrinkband is positioned under the bases of the articles and under the bottom edge of the backing member. The uppermost edge of the shrinkband is positioned below the finger hole so that the finger hole remains open, and the uppermost edge of the shrinkband is positioned above the side notch of the backing member so that the shrinkband engages the side notch to prevent the backing member from sliding out of the shrinkband when the package is handled.

BRIEF DESCRIPTION OF THE DRAWINGS

While the specification concludes with claims which particularly point out and distinctly claim the present invention, it is believed that the present invention will be better understood from the following description of preferred embodiments, taken in conjunction with the accompanying drawings, in which like reference numerals identify identical elements and wherein:

DETAILED DESCRIPTION OF THE INVENTION

Figure 1:
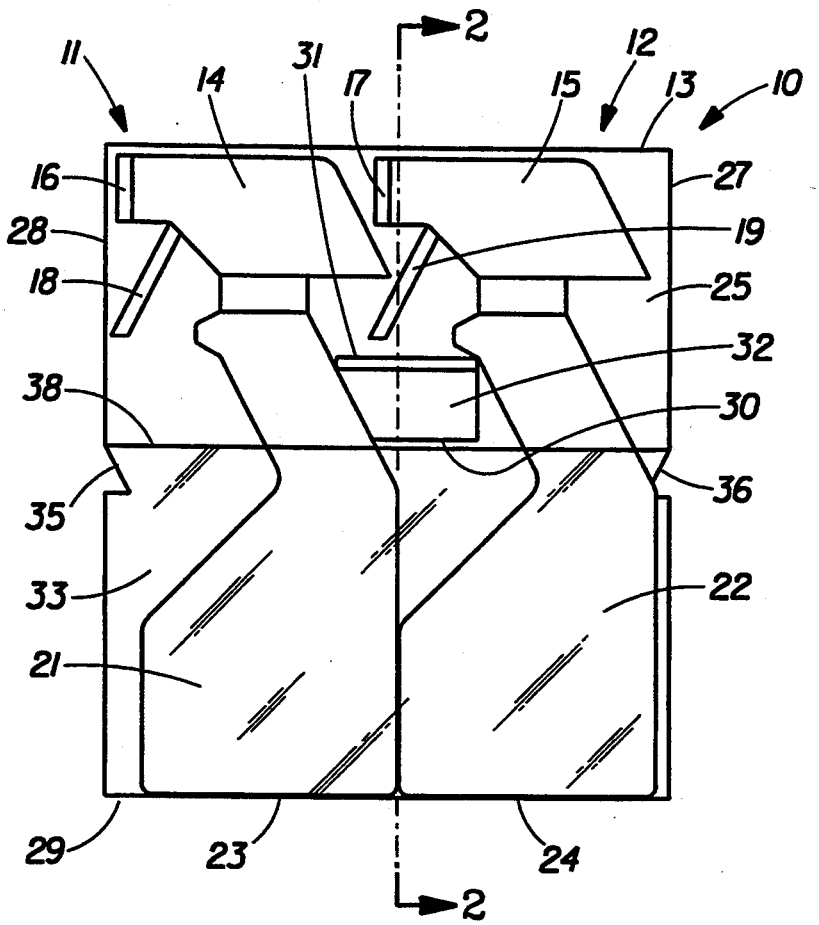
FIG. 1 is a front elevation view of a preferred embodiment of the package for multiple articles of the present invention, disclosing two trigger sprayers shrinkbanded to a backing member.
Figure 2:
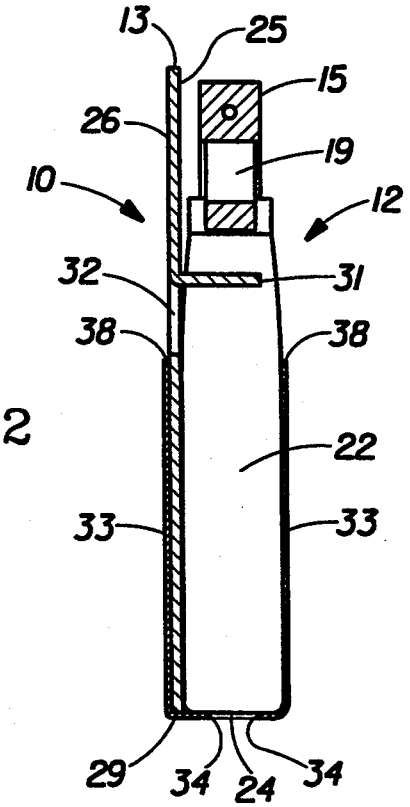
FIG. 2 is a sectioned side elevation view, taken along section line 2—2 of FIG. 1, showing a finger hole formed in the backing member by folding a flap perpendicular to the backing member and positioned between the two trigger sprayers.

Referring now to the drawings, and more particularly to FIGS. 1 and 2, there is shown a first preferred embodiment of the present invention, which provides a package for multiple articles, generally indicated as 10. Two trigger sprayers, indicated as 11 and 12, are arranged upright and end-to-end against a backing member 13. Sprayers 11 and 12 have head portions 14 and 15 which include nozzles 16 and 17 and triggers 18 and 19, respectively. Sprayers 11 and 12 include bodies 21 and 22, respectively. Bodies 21 and 22 have bottom bases 23 and 24, respectively. Head portions 14 and 15 are typically connected to sprayer bodies 21 and 22 by conventional threaded connecting rings.

The flat backing member 13 has a front face 25, a back face 26, a right edge 27, a left edge 28, and a bottom edge 29. Backing member 13 extends just slightly above the top of the tallest article in the package. Strategically positioned below the top of the tallest article is an upward-facing C-shaped slit 30 cut through backing member 13. The C-shape has two leg ends facing upward. C-shaped slit 30 enables a flap of backing material 31 to be folded approximately 90° outward from front face 25 between adjacent sprayers 11 and 12. Flap 31 is folded about a horizontal axis joining the leg ends of the C-shaped slit 30. The flap 31 is positioned between sprayers 11 and 12 and is sized to space the nozzle 17 and trigger 19 of sprayer 12 from the body 21 and head portion 14 of sprayer 11 while bodies 21 and 22 continue to contact each other. The aperture created in the backing member 13, by folding the flap 31, forms a finger hole 32 for carrying the bundle package 10. It will be apparent to those skilled in the art that different shapes of flaps generated by cutting slits in the backing member may be used to provide spacing between adjacent articles, for example, curved, rectangular, triangular, etc. In addition, the slits could be cut to enable the flaps to be folded downward.

A Shrinkband 33 is wrapped around sprayers 11 and 12 and backing member 13. The shrinkband 33 has a lowermost edge 34 extending below bases 23 and 24 of sprayers 11 and 12 and bottom edge 29 of backing member 13 so that when shrunk, shrinkband 33 will partially extend under bases 23 and 24 and bottom edge 29 to support sprayers 11 and 12. Shrinkband 33 has an uppermost edge 38 positioned just below the finger hole 32 to permit access to the finger hole for carrying the package. Backing member 13 has two edge notches 35 and 36, which are positioned below the uppermost edge 38 of shrinkband 33 so that when the shrinkband is shrunk, shrinkband 33 will engage the notches 35 and 36 in order to prevent backing member 13 from sliding out of shrinkband 33 when package 10 is handled. The damageable head portions 14 and 15 of sprayers 11 and 12 remain above the uppermost edge 38 of the shrinkband 33 in order to minimize shrink forces applied to the head portions. Sprayers 11 and 12 cannot be removed from package 10 unless flap 31 is first folded back into front face 25 of backing member 13 or shrinkband 33 is removed by the consumer.

Figure 3:
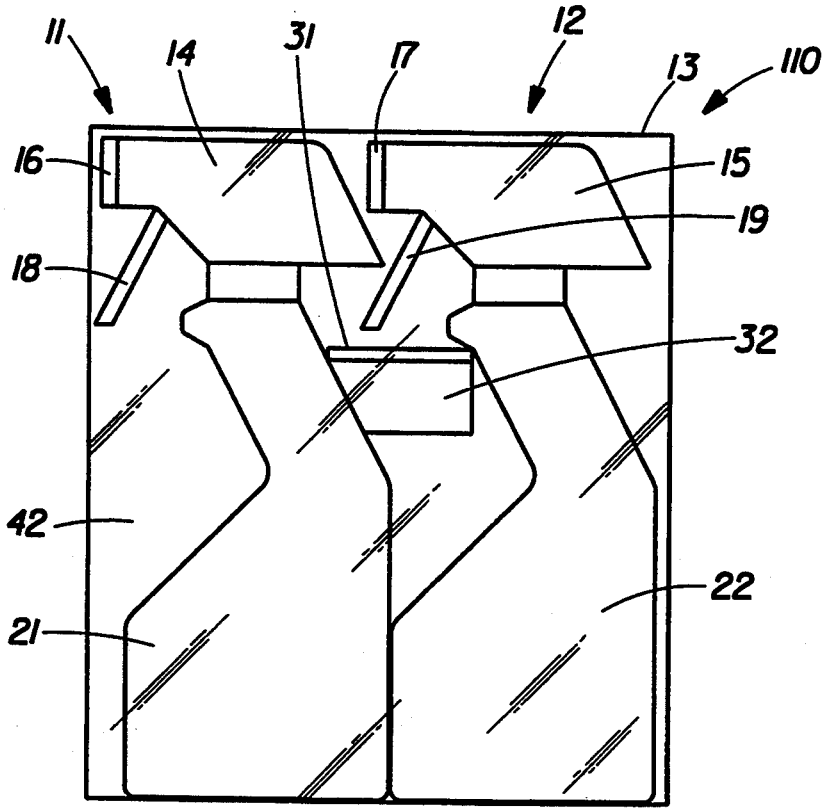
FIG. 3 is a front elevation view of an alternative embodiment of the package for multiple articles of the present invention, disclosing two trigger sprayers shrinkwrapped to a backing member.
Figure 4:
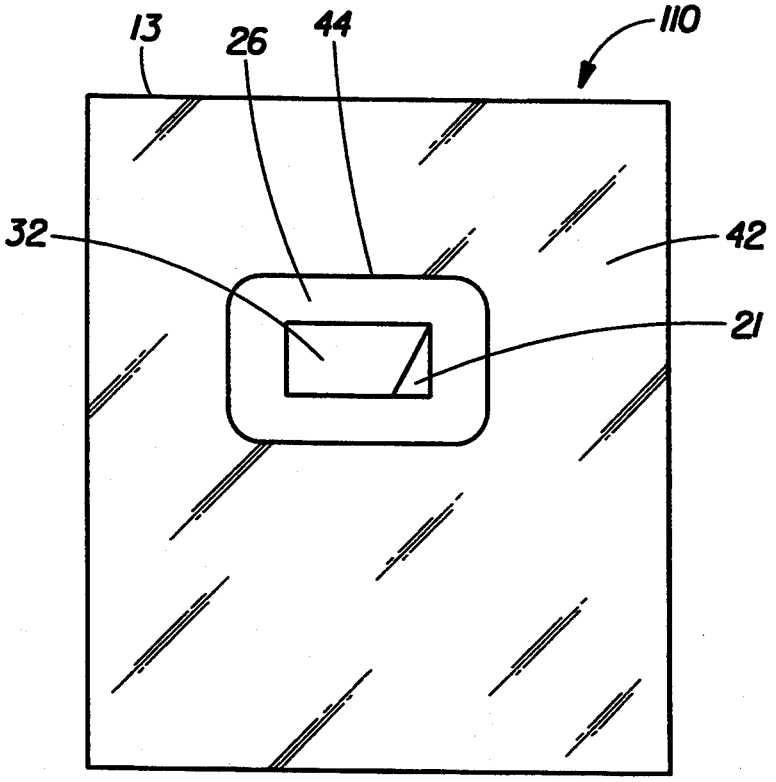
FIG. 4 is a rear elevation view thereof showing a finger hole aperture in the backing member aligned with an access hole in the shrinkwrap.
Figure 5:
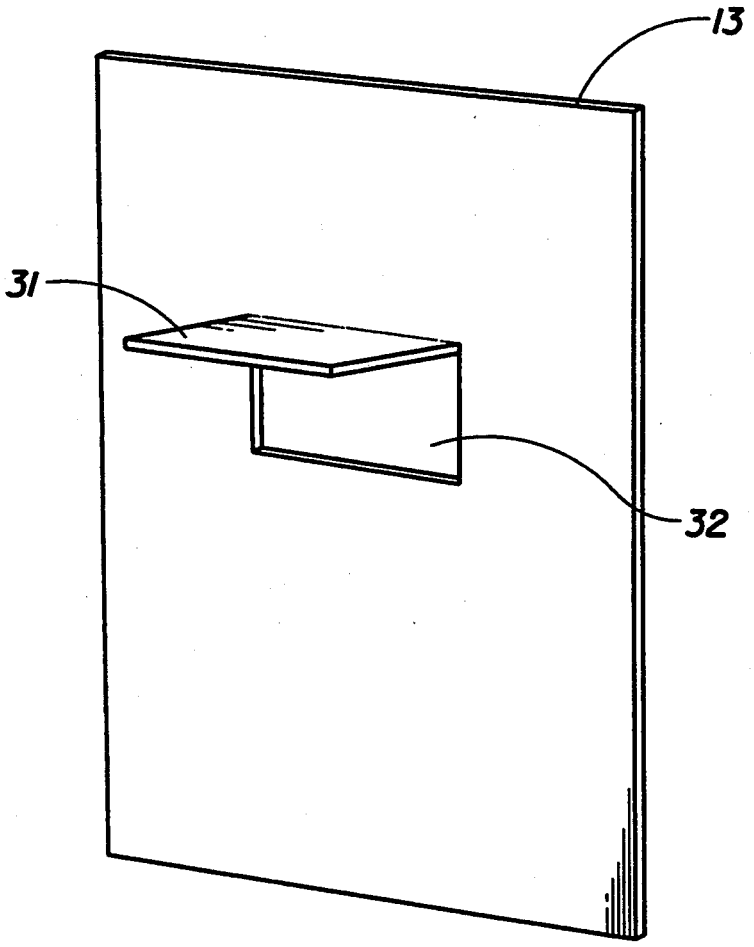
FIG. 5 is a perspective view of the backing member of the package of FIG. 3, showing a finger hole flap.

Another preferred embodiment of the package for multiple articles of the present invention is shown in FIGS. 3 and 4, and is generally indicated as 110. Package 110 is wrapped with a shrinkwrapping material 42, which completely encloses cardboard backing member 13 and sprayers 11 and 12 resting against backing member 13. Package 110 also has a flap 31, forming a finger hole 32, folded between sprayers 11 and 12 in order to space the sprayer head 15 of sprayer 12 from sprayer head 14 and body 21 of sprayer 11, thereby preventing damage to nozzle 17 and premature actuation of trigger 19 of sprayer 12. FIG. 5 shows backing member 13 of package 110 by itself in order to more clearly illustrate finger hole 32 and flap 31. Although finger hole 32 and flap 31 are shown to be rectangular, any hole shape large enough for fingers, with resulting flap shaped to provide the desired spacing between sprayer heads, is acceptable. Since shrinkwrap material 42 encloses the backing member 13 and the sprayers 11 and 12, finger hole 32 cannot be used for carrying package 110 unless a portion of the shrinkwrap material 42 is cut away from the area around finger hole 32, creating an access hole 44 aligned with finger hole 32. The process of cutting access hole 44 preferably occurs after shrinkwrap 42 is shrunk in place. If hole 44 were cut before shrinking, hole 44 would have to be aligned with finger hole 32 before shrinking could occur. FIG. 4 shows the rear of backing member 13 to illustrate the access hole 44 cut in the shrinkwrap 42. Hole 44 is preferably cut by hand with a sharp knife without cutting completely through backing member 13. The step of cutting away access hole 44 may be eliminated if the package is easily handled without use of the finger hole 32.

Although shrinkwrapping is a common method for securing multiple articles to a backing member, other securement means include elastic bands, tape, and wire. Tapes may use pressure sensitive adhesive to attach themselves around articles and to the backing member. Wires and elastic bands may require small holes or slits cut into the backing member in order to pass their ends through or around the backing member for securement of articles to the backing member.

In a particularly preferred embodiment of the present invention, two sprayers 11 and 12 are 17.0 fluid oz. trigger sprayers, each having a height of approximately 27 cm. Backing member 13 is 20 cm wide by 27.6 cm high and is made of 32 pound B-flute corrugated. Shrinkband 33, when heat sealed together as a continuous band before shrinking, is 480 mm in circumference, 162 mm wide and 0.06 mm thick, clear, oriented polyethylene terephthalate.

The shrinkband is shrunk in a heated tunnel at 150° C. for about 4 seconds to form the shrinkbanded package of FIGS. 1 and 2. Flap 31 is 66.7 mm wide and extends outward from backing member 13 by 35 mm. The bottom of finger hole 32 is 162 mm from the bottom edge 29 of the backing member 13. Notches 35 and 36 are cut 8 mm cm into the side edges 27 and 28 of backing member 13 at an angle of 65° starting at 143 mm from the bottom edge 29 of the backing member 13, and 90° starting at 127 mm from the bottom edge of the backing member.

Flap 31 is preferably formed into backing member 13 with what is commonly known as a locking score. That is, the outer portions of the horizontal bend line of the flap are scored while the center portion is cut through the backing member. This minimizes the length of the bend line and thereby reduces the material memory force tending to return the flap 31 to its unfolded position. Furthermore, the center portion is cut slightly below the bend line. This arrangement also helps the flap maintain its perpendicular orientation and not return to its unfolded position.

While particular embodiments of the present invention have been illustrated and described, it will be obvious to those skilled in the art that various changes and modifications may be made without departing from the spirit and scope of the invention, and it is intended to cover in the appended claims all such modifications that are within the scope of the invention.

What is claimed is:

1. A package for multiple articles comprising:

a) at least two articles placed adjacent each other, said articles each having a base;

b) an upright backing member placed against said articles, said backing member having a bottom edge and at least one finger hole, said at least one finger hole being formed by cutting and then folding a flap of said backing member substantially perpendicular to said backing member between said adjacent articles, said flap having opposing edges, said flap positioned between said articles such that said opposing edges contact said articles and thereby maintain spacing between said articles; and c) means for securing said adjacent articles against said backing member; said bases of said articles being substantially perpendicular to said upright-backing member.

2. The package of claim 1 wherein said means for securing said adjacent articles to said backing member comprises a shrinkwrap enclosing said adjacent articles and said backing member.

3. The package of claim 2 wherein said shrinkwrap has an aperture cut therein aligned with said at least one finger hole in said backing member to enable said package to be carried by said at least one finger hole.

4. The package of claim 1 wherein said means for securing said adjacent articles to said backing member comprises a shrinkband surrounding said adjacent articles and said backing member, said shrinkband having an uppermost edge and a lowermost edge, said lowermost edge of said shrinkband being positioned under said base of each of said articles and said bottom edge of said backing member, said uppermost edge of said shrinkband being positioned below said at least one finger hole, so that said at least one finger hole remains open for carrying said package by said at least one finger hole.

5. A package for multiple articles comprising:

a) at least two articles placed adjacent each other, each of said articles having a head portion;

b) an upright backing member placed against said articles, said articles being on the same side of said backing member having at least one finger hole located between said articles, said at least one finger hole being formed by cutting and then folding a flap of said backing member between two of said adjacent articles, said flap maintaining spacing between said head portions of said articles to prevent said head portions of said articles from being damaged; and c) a shrinkwrap enclosing said adjacent articles and said backing member, said shrinkwrap securing said articles to said backing member.

6. The package of claim 5 wherein said shrinkwrap has an aperture cut therein aligned with said at least one finger hole in said backing member to enable said package to be carried by said at least one finger hole.

7. The package of claim 5 wherein said at least one finger hole is formed by cutting an upward-facing C-shaped slit, said C-shaped slit having leg ends, and then folding said flap about a horizontal axis connecting said leg ends of said C-shaped slit, said flap being folded substantially perpendicular to said backing member.

8. A package for multiple articles comprising:

a) at least two articles placed adjacent each other, each of said articles having a base and a head portion;

b) an upright backing member placed against said articles, said backing member having a bottom edge, said backing member also having at least one finger hole, said at least one finger hole being formed by cutting and then folding a flap of said backing member between two of said adjacent articles, said flap maintaining spacing between said head portions of said articles to prevent said head portions of said articles from being damaged; and c) shrinkband surrounding said adjacent articles and said backing member, said shrinkband having an uppermost edge and a lowermost edge, said lowermost edge of said shrinkband being positioned under said bases of said articles and said bottom edge of said backing member to support said articles, said backing member having at least one side notch positioned below said uppermost edge of said shrinkband so that said shrinkband engages said side notch to prevent said backing member from sliding out of said shrinkband when said package is handled.

9. The package of claim 8 wherein said uppermost edge of said shrinkband is positioned below said at least one finger hole.

10. The package of claim 8 wherein said cutting and folding of said flap comprises cutting an upward-facing C-shaped slit, said C-shaped slit having leg ends, and then folding said flap about a horizontal axis connecting said leg ends of said C-shaped slit, said flap being folded substantially perpendicular to said backing member.

* * * * *